US009787029B1

(12) United States Patent
Chen

(10) Patent No.: US 9,787,029 B1
(45) Date of Patent: Oct. 10, 2017

(54) HIGH SPEED CONNECTOR ASSEMBLY, RECEPTACLE CONNECTOR AND PLUG CONNECTOR

(71) Applicant: Oupiin Electronic (Kunshan) Co., Ltd., Kunshan (CN)

(72) Inventor: Hsin Chih Chen, Kunshan (CN)

(73) Assignee: OUPIIN ELECTRONIC (KUNSHAN) CO., LTD., Kunshan (CN)

( * ) Notice: Subject to any disclaimer, the term of this patent is extended or adjusted under 35 U.S.C. 154(b) by 0 days.

(21) Appl. No.: 15/379,511

(22) Filed: Dec. 15, 2016

(30) Foreign Application Priority Data

Jun. 13, 2016 (CN) ..... 2016 1 0409570

(51) Int. Cl.

| | |
|---|---|
| ***H01R 24/00*** | (2011.01) |
| ***H01R 13/6461*** | (2011.01) |
| ***H01R 13/26*** | (2006.01) |
| ***H01R 13/502*** | (2006.01) |

(52) U.S. Cl.
CPC ..... *H01R 13/6461* (2013.01); *H01R 13/26* (2013.01); *H01R 13/502* (2013.01)

(58) Field of Classification Search
CPC ... H01R 13/6461; H01R 13/502; H01R 13/26
USPC ..... 439/676
See application file for complete search history.

(56) References Cited

U.S. PATENT DOCUMENTS

2016/0079704 A1* 3/2016 Chen ..... H01R 13/631 439/374

* cited by examiner

*Primary Examiner* — Javaid Nasri
(74) *Attorney, Agent, or Firm* — JMB Davis Ben-David

(57) ABSTRACT

A high speed connector assembly is disclosed in this invention, including a receptacle connector and a plug connector. Each receptacle terminal of the receptacle connector disposes a first L-type contact piece, and each plug terminal of the plug connector disposes a second L-type contact piece. When the receptacle connector and the plug connector are electrically engaged, an extension section of the first L-type contact piece is pressed on a straight part of the second L-type contact piece, and an extension part of the second L-type contact piece is pressed on a straight section of the first L-type contact piece. So this engagement can form a double-contacts structure to restrain the short pile effect and reduce the crosstalk and loss at high speed signal transmission. A receptacle connector and a plug connector are also disclosed in this invention.

11 Claims, 8 Drawing Sheets

HIGH SPEED CONNECTOR ASSEMBLY, RECEPTACLE CONNECTOR AND PLUG CONNECTOR

CROSS REFERENCE TO RELATED APPLICATIONS

Benefit is claimed to Chinese Patent Application No. 201610409570.5, filed Jun. 13, 2016, the contents of which are incorporated by reference herein in their entirety.

BACKGROUND OF THE INVENTION

1. Field of the Invention

The present invention relates to a connector technology, and more particularly to a high speed connector assembly, a receptacle connector and a plug connector, which can form double contacts between a receptacle terminal and a plug terminal.

2. Description of the Prior Art

In the electronics industry, a right-angle high speed connector assembly can provide a connection interface for multiple circuit boards. For example, it can connect two orthogonal circuit boards to shorten the signal transmission channel length of these systems and improve the channel performance of signal integrity.

The high speed connector assembly is one common connector, which is used for large scale communication equipment, a super high performance server, a huge computer, an industrial computer and a high end storage device. This highly flexible high performance connector has become an ideal choice for telecommunications and data network applications.

However, it is a very important issue how to provide greater throughput and ensure more stable and reliable signal transmission by changing the signal transmission path between a receptacle connector and a plug connector under the condition of no redesign to above connection.

BRIEF SUMMARY OF THE INVENTION

One object of the present invention is to provide a high speed connector assembly, which comprises a receptacle connector and a plug connector, wherein each receptacle terminal and each plug terminal are provided with an L-type contact piece, and the receptacle connector and the plug connector are engaged with each other and can form double contacts between the receptacle terminal and the plug terminal, to restrain the short pile effect and reduce the crosstalk and loss at high speed signal transmission.

The other object of the present invention is to provide a receptacle connector, each receptacle terminal of which is provided with a first L-type contact piece to restrain the short pile effect and reduce the crosstalk and loss at high speed signal transmission.

Another object of the present invention is to provide a plug connector, each plug terminal of which is provided with a second L-type contact piece to restrain the short pile effect and reduce the crosstalk and loss at high speed signal transmission.

Other objects and advantages of the present invention may be further understood from the technical features disclosed by the present invention.

To achieve the aforementioned object or other objects of the present invention, the present invention adopts the following technical solution.

The present invention provides a high speed connector assembly, which comprises a receptacle connector and a plug connector. The receptacle connector includes at least an insulating cover and multiple terminal modules fixed in the insulating cover and arranged in parallel. Each terminal module includes an insulating frame and a terminal group retained in the insulating frame. The terminal group includes a plurality of receptacle terminals, each of which has a main plate located in a first vertical plane, a first L-type contact piece extending forward from one end of the main plate, and a lower mounting portion extending downward from the other end of the main plate. The first L-type contact piece has a straight section and an extension section. The straight section is located in the first vertical plane, is connected with the main plate and horizontally extends forward. The extension section is perpendicular to the first vertical plane, is formed by bending one edge of the straight section and is located near the front of the straight section. The plug connector includes a plug housing and multiple rows of plug terminals mounted in the plug housing. Each plug terminal has a second L-type contact piece and a mounting part connected with the second L-type contact piece. The second L-type contact piece has a straight part located in a second vertical plane and an extension part being perpendicular to the second vertical plane and formed by bending one edge of the straight part. The extension part is located near the top of the straight part. Wherein the second vertical plane is parallel to the first vertical plane. When the receptacle connector and the plug connector are electrically engaged with each other, the extension section of the first L-type contact piece is pressed on the straight part of the second L-type contact piece to form the electrical connection between the receptacle and plug terminals; and the extension part of the second L-type contact piece is pressed on the straight section of the first L-type contact piece to form the electrical connection.

In one embodiment, the first L-type contact piece further has a receptacle-guiding section formed by bending the front of the straight section along the direction away from the extension section; the extension section extends toward the plug terminal, but the receptacle-guiding section extends away from the plug terminal; and the second L-type contact piece further has a plug-guiding part formed by bending the top of the straight part along the direction away from the extension part; the extension part extends toward the receptacle terminal, but the plug-guiding part extends away from the receptacle terminal.

In one embodiment, the straight section of the receptacle terminal has at least a wide side located in the first vertical plane, and the extension section is formed by perpendicularly bending one edge of the wide side; and the straight part of the plug terminal has at least a wide surface located in the second vertical plane, and the extension part is formed by perpendicularly bending one edge of the wide surface; when the receptacle connector and the plug connector are engaged with each other, the extension section of the first L-type contact piece can contact with the wide surface of the second L-type contact piece to form the electrical connection; and the extension part of the second L-type contact piece can contact with the wide side of the first L-type contact piece to form the electrical connection.

In one embodiment, the main plate is L type, the lower mounting portion is located in the first vertical plane, and the mounting part is located in the second vertical plane.

In one embodiment, the receptacle terminals of each terminal group include multiple pairs of differential signal receptacle terminals and multiple grounding receptacle terminals; there are two grounding receptacle terminals respectively arranged on two sides of each pair of differential signal receptacle terminals; each pair of differential signal receptacle terminals includes two differential signal receptacle terminals, the first L-type contact pieces of which are symmetrical; and each row of plug terminals includes multiple pairs of differential signal plug terminals and multiple grounding plug terminals; there are two grounding plug terminals respectively arranged on two sides of each pair of differential signal plug terminals; each pair of differential signal plug terminals includes two differential signal plug terminals, the second L-type contact pieces of which are symmetrical.

In one embodiment, the plug housing includes a base and two sidewalls standing on two sides of the base; and the base forms multiple rows of insertion holes to be used to hold the corresponding plug terminals.

The present invention further provides a receptacle connector, which comprises an insulating cover and multiple terminal modules. The terminal modules are fixed in the insulating cover and arranged in parallel. Each terminal module includes an insulating frame and a terminal group retained in the insulating frame. The terminal group includes a plurality of receptacle terminals, at least one of which has a main plate located in a first vertical plane, a first L-type contact piece extending forward from one end of the main plate, and a lower mounting portion extending downward from the other end of the main plate. The first L-type contact piece has a straight section and an extension section. The straight section is located in the first vertical plane, is connected with the main plate and horizontally extends forward. The extension section is perpendicular to the first vertical plane, is formed by bending one edge of the straight section and is located near the front of the straight section.

The present invention further provides a plug connector, which comprises a plug housing and multiple rows of plug terminals. The plug housing includes a base and two sidewalls standing on two sides of the base. The base forms multiple rows of insertion holes. The plug terminals are mounted in the plug housing and held in the corresponding insertion holes. At least one of the plug terminals has a second L-type contact piece and a mounting part connected with the second L-type contact piece. The second L-type contact piece has a straight part located in a second vertical plane and an extension part being perpendicular to the second vertical plane and formed by bending one edge of the straight part. The extension part is located near the top of the straight part.

In comparison with the prior art, the receptacle connector of the present invention disposes the receptacle terminals, each of which disposes the first L-type contact piece; and the plug connector of the present invention disposes the plug terminals, each of which disposes the second L-type contact piece. Therefore, there can form a double-contacts structure between the receptacle and plug terminals when the receptacle connector and the plug connector are electrically engaged with each other. By this electrical engagement, the high speed connector assembly of the present invention can restrain the short pile effect and reduce the crosstalk and loss when the transmission rate of the high speed signal is greater than 25 Gbps-40 Gbps.

DETAILED DESCRIPTION OF THE PREFERRED EMBODIMENTS

The following description of every embodiment with reference to the accompanying drawings is used to exemplify a specific embodiment, which may be carried out in the present invention. Directional terms mentioned in the present invention, such as "up", "down", "front", "back", "left", "right", "top", "bottom" etc., are only used with reference to the orientation of the accompanying drawings. Therefore, the used directional terms are intended to illustrate, but not to limit, the present invention.

Figure 1:
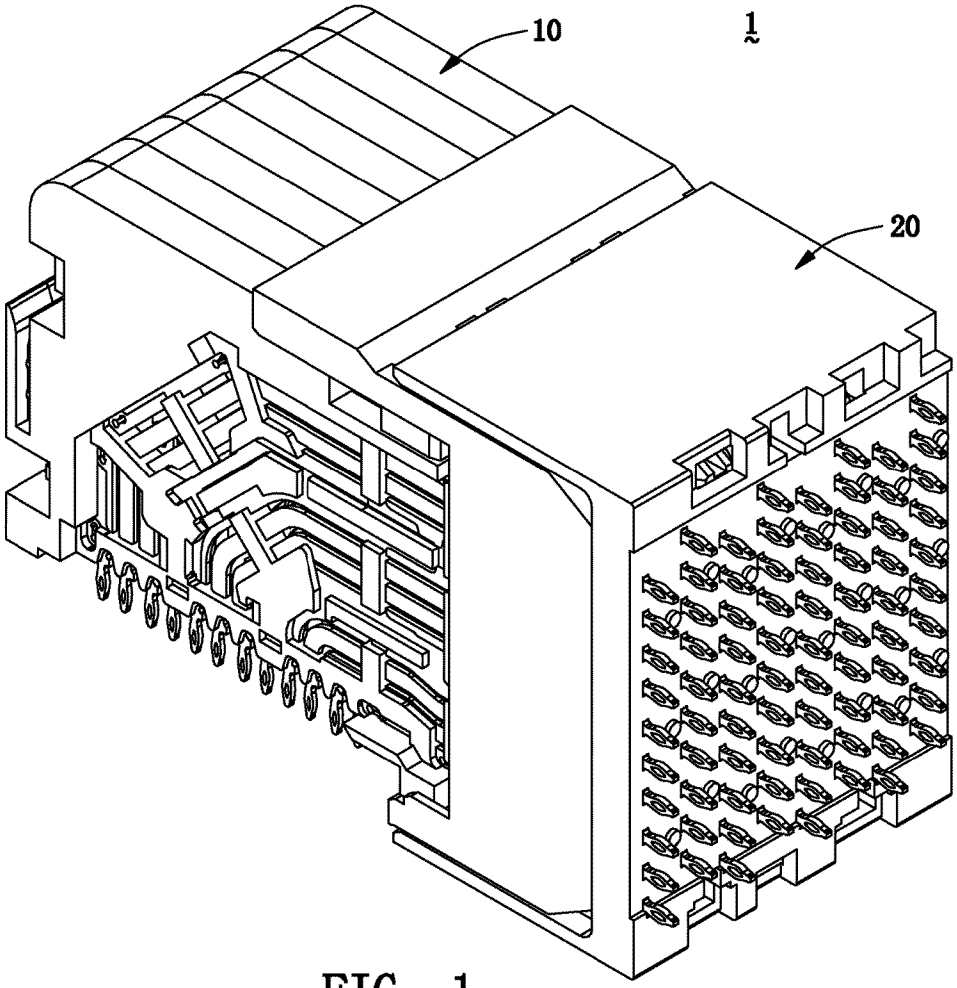
FIG. 1 is a perspective view of a high speed connector assembly of the present invention.
Figure 2:
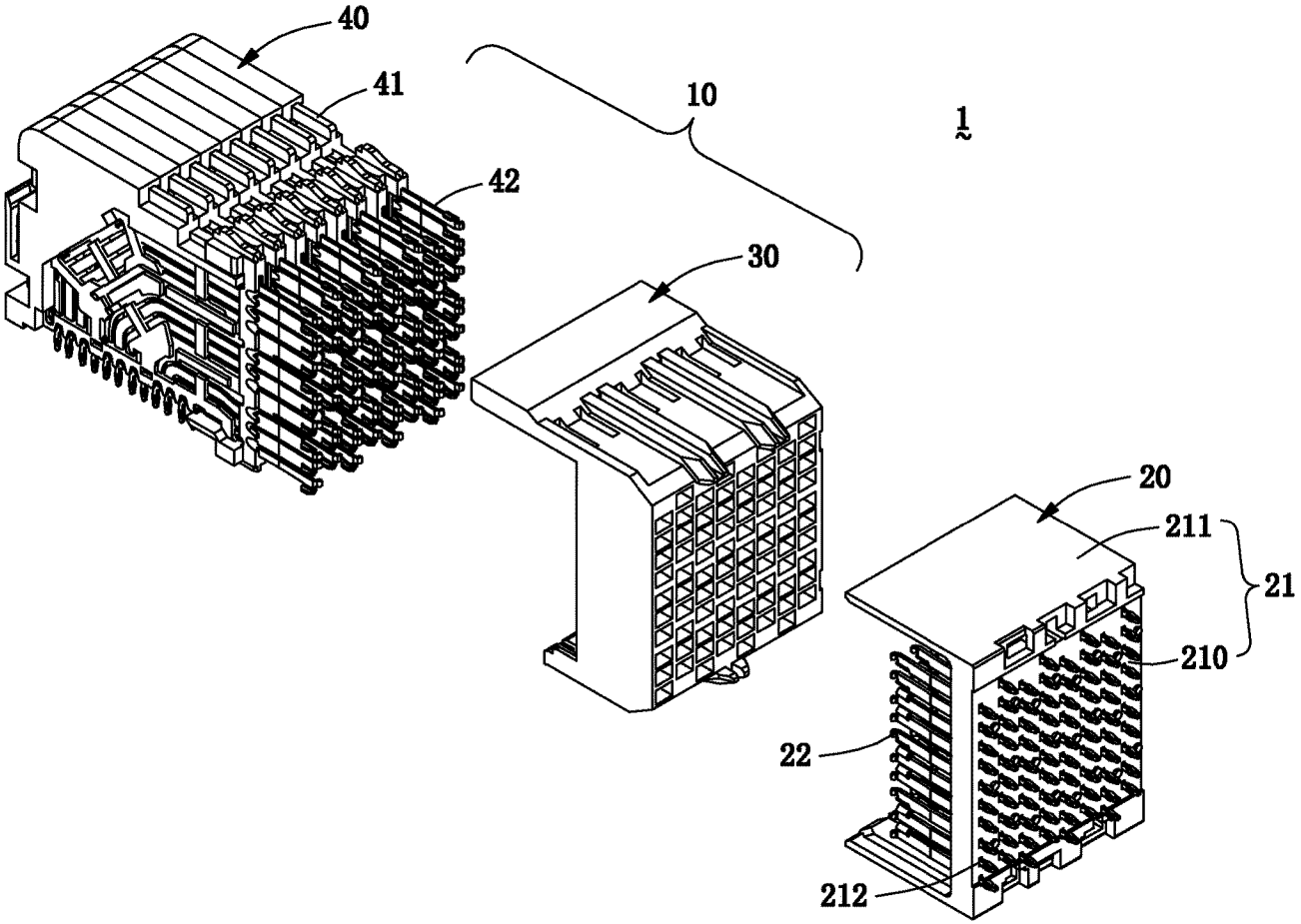
FIG. 2 is a disassembled view of the high speed connector assembly of the present invention.
Figure 3:
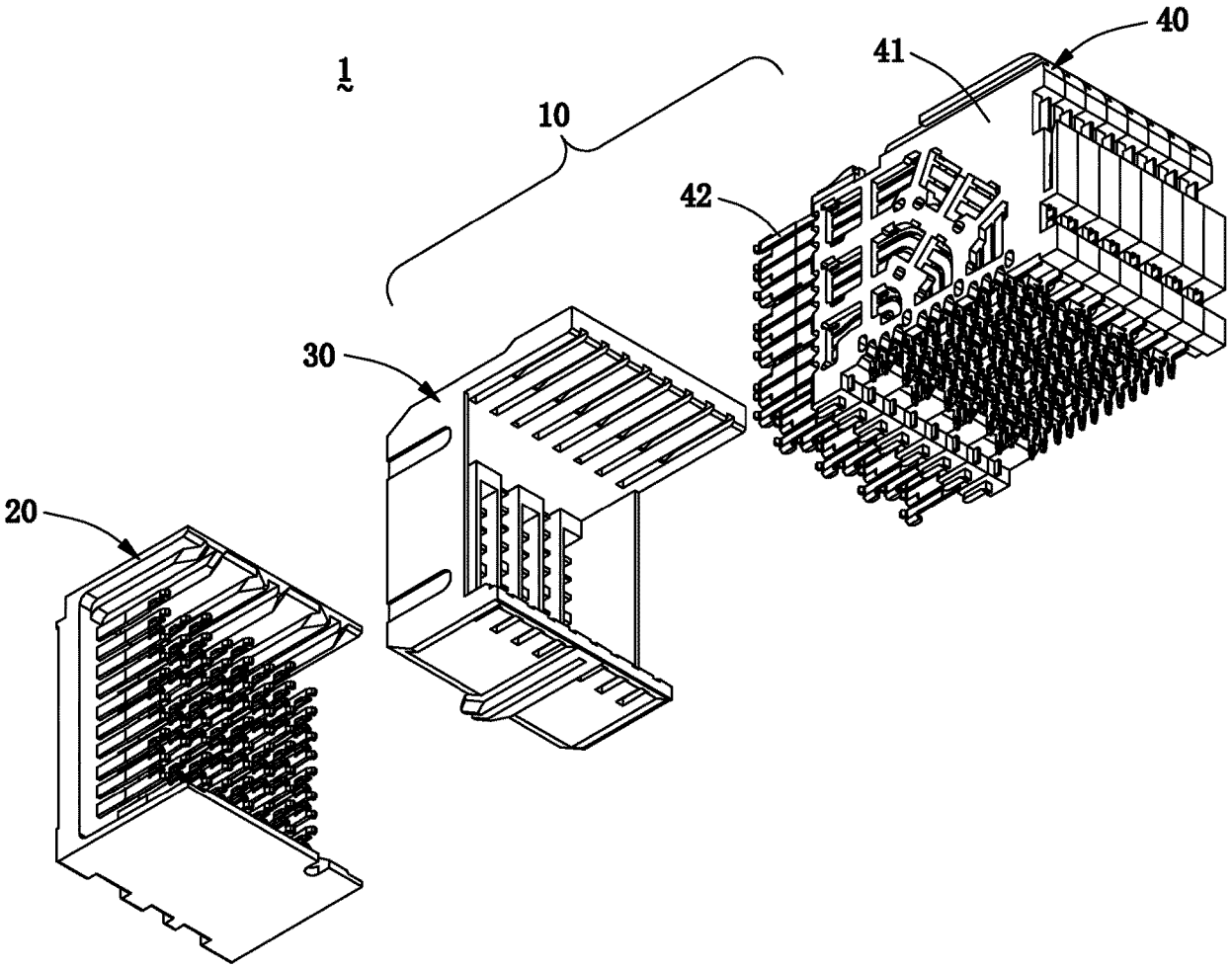
FIG. 3 is a disassembled view of the high speed connector assembly along another direction.

Please refer to FIGS. 1 to 3, a high speed connector assembly of the present invention includes a receptacle connector 10 and a plug connector 20. The receptacle connector 10 may be a right-angle connector, the mating direction of which is parallel to a horizontal circuit board (not shown), on which the receptacle connector 10 is mounted. The plug connector 20 may be a vertical end connector, the mating direction of which is perpendicular to a vertical circuit board (not shown), on which the plug connector 20 is mounted.

Please refer to FIGS. 2 and 3, the receptacle connector 10 includes at least an insulating cover 30 and multiple terminal modules 40 mounted in the insulating cover 30 and arranged in parallel from left to right. In the embodiment, the receptacle connector 10 includes eight terminal modules 40. But in other embodiments, the number of the terminal modules 40 can be changed to increase the density of the receptacle connector 10. Each terminal module 40 includes at least an insulating frame 41 and a terminal group 42 retained in the insulating frame 41.

Figure 4:
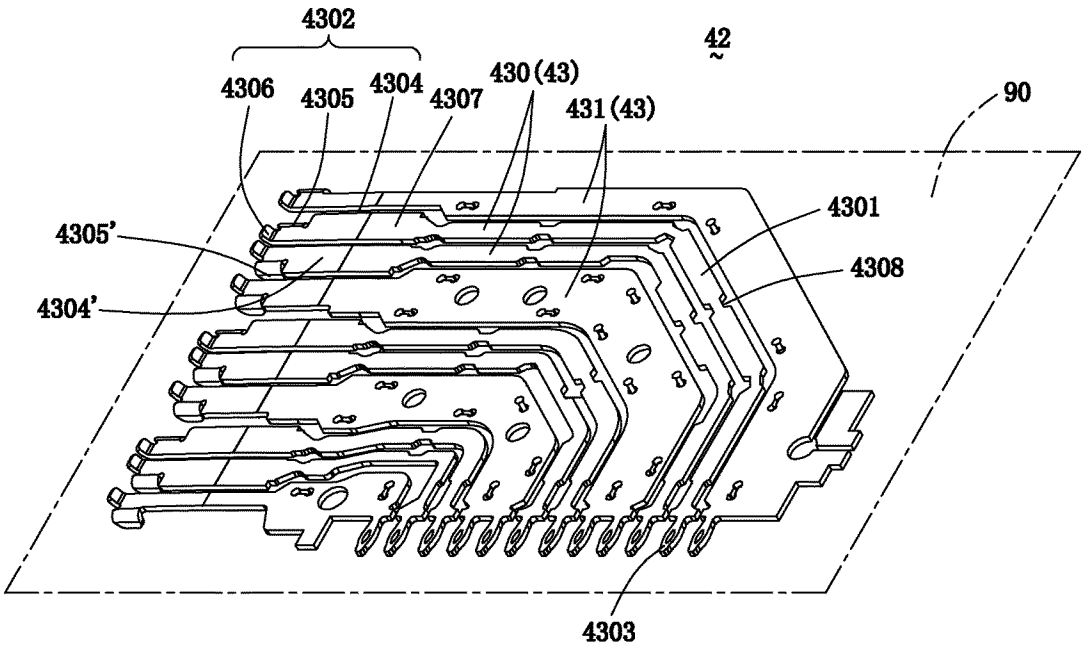
FIG. 4 is a perspective view of one receptacle terminal group of a receptacle connector of the present invention.

Referring to FIG. 4, the terminal group 42 includes a plurality of receptacle terminals 43 located in a first vertical plane 90. In the embodiment, these receptacle terminals 43 include multiple pairs of differential signal receptacle terminals 430 and multiple grounding receptacle terminals 431. There are two grounding receptacle terminals 431 respectively arranged on two sides of each pair of differential signal receptacle terminals 430. Each pair of differential signal receptacle terminals 430 includes two differential signal receptacle terminals 430. In the embodiment, the grounding receptacle terminal 431 and the differential signal receptacle terminal 430 have roughly the same structure, and the biggest difference is that their dimensions are different. For example, the width of the grounding receptacle terminal 431 is larger than that of the differential signal receptacle terminal 430.

The following text takes one of the differential signal receptacle terminals 430 as an example to specifically describe the structure of the receptacle terminal 43 of the present invention.

Referring to FIG. 4, the differential signal receptacle terminal 430 has a main plate 4301 located in the first vertical plane 90, a first L-type contact piece 4302 extending forward from one end of the main plate 4301, and a lower mounting portion 4303 extending downward from the other end of the main plate 4301. In the embodiment, the first L-type contact piece 4302 has a straight section 4304 and an extension section 4305. The straight section 4304 is located in the first vertical plane 90, is connected with the main plate 4301 and horizontally extends forward. The extension section 4305 is perpendicular to the first vertical plane 90 and formed by perpendicularly bending one edge of the straight section 4304. Moreover, the extension section 4305 is located near the front of the straight section 4304. The first L-type contact piece 4302 further has a receptacle-guiding section 4306 formed by bending the front of the straight section 4304 along the direction away from the extension section 4305.

In the embodiment, the straight section 4304 has at least a wide side 4307 located in the first vertical plane 90. The extension section 4305 is formed by perpendicularly bending one edge of the wide side 4307. So the one edge of the wide side 4307 is the abovementioned one edge of the straight section 4304.

In the embodiment, the main plate 4301 is L type. The main plate 4301 and the lower mounting portion 4303 are located in the first vertical plane 90.

Referring to FIG. 4, the first L-type contact pieces 4302 of one pair of differential signal receptacle terminals 430 are symmetrical. Specifically, the extension section 4305 of one differential signal receptacle terminal 430 is located on an upper edge of the straight section 4304, and the extension section 4305' of the other differential signal receptacle terminal 430 is located on a lower edge of the straight section 4304'.

Referring to FIG. 4, the straight section 4304 further has multiple notches 4308 on two opposite edges thereof to be used for regulating terminal impedance. The lower mounting portion 4303 is a needle shaped pin, which can be connected to a signal point of the horizontal circuit board.

Please refer to FIG. 2, the plug connector 20 includes a plug housing 21 and multiple rows of plug terminals 22 mounted in the plug housing 21. The plug housing 21 includes a base 210 and two sidewalls 211 standing on two sides of the base 210. The base 210 forms multiple rows of insertion holes 212 to be used to hold the corresponding plug terminals 22. In the embodiment, the plug connector 20 includes eight rows of plug terminals 22, which can be electrically connected to the corresponding eight terminal modules 40.

Figure 5:
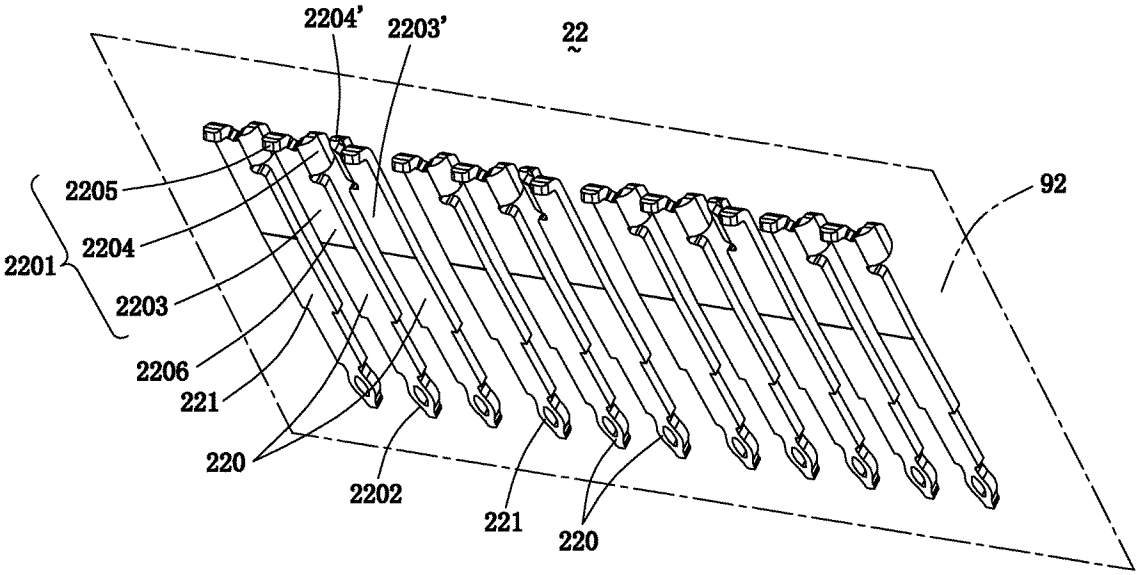
FIG. 5 is a perspective view of one row of plug terminals of a plug connector of the present invention.

Please refer to FIG. 5, each row of plug terminals 22 includes multiple pairs of differential signal plug terminals 220 and multiple grounding plug terminals 221. There are two grounding plug terminals 221 respectively arranged on two sides of each pair of differential signal plug terminals 220. In the embodiment, these differential signal plug terminals 220 and these grounding plug terminals 221, which are arranged in the same row, are located in a second vertical plane 92. Each pair of differential signal plug terminals 220 includes two differential signal plug terminals 220. In the embodiment, the grounding plug terminal 221 and the differential signal plug terminal 220 have roughly the same structure.

The following text takes one of the differential signal plug terminals 220 as an example to specifically describe the structure of the plug terminal 22 of the present invention.

Referring to FIG. 5, the differential signal plug terminal 220 has a second L-type contact piece 2201 and a mounting part 2202 connected with the second L-type contact piece 2201. The second L-type contact piece 2201 has a straight part 2203 and an extension part 2204. The straight part 2203 is located in the second vertical plane 92. The extension part 2204 is perpendicular to the second vertical plane 92 and formed by perpendicularly bending one edge of the straight part 2203. Moreover, the extension part 2204 is adjacent to the top of the straight part 2203. The second L-type contact piece 2201 further has a plug-guiding part 2205 formed by bending the top of the straight part 2203 along the direction away from the extension part 2204.

In the embodiment, the straight part 2203 has at least a wide surface 2206 located in the second vertical plane 92. The extension part 2204 is formed by perpendicularly bending one edge of the wide surface 2206. So the one edge of the wide surface 2206 is the abovementioned one edge of the straight part 2203.

In the embodiment, the second vertical plane 92 is parallel to the first vertical plane 90, and the mounting part 2202 is located in the second vertical plane 92.

Referring to FIG. 5, the second L-type contact pieces 2201 of each pair of differential signal plug terminals 220 are symmetrical to each other. In detail, the extension part 2204 of one differential signal plug terminal 220 is located on a right edge of the straight part 2203, and the extension part 2204' of the other differential signal plug terminal 220 is located on a left edge of the straight part 2203'.

The following text will introduce the electrical engagement between the receptacle terminal 430 and the plug terminal 220.

Figure 6:
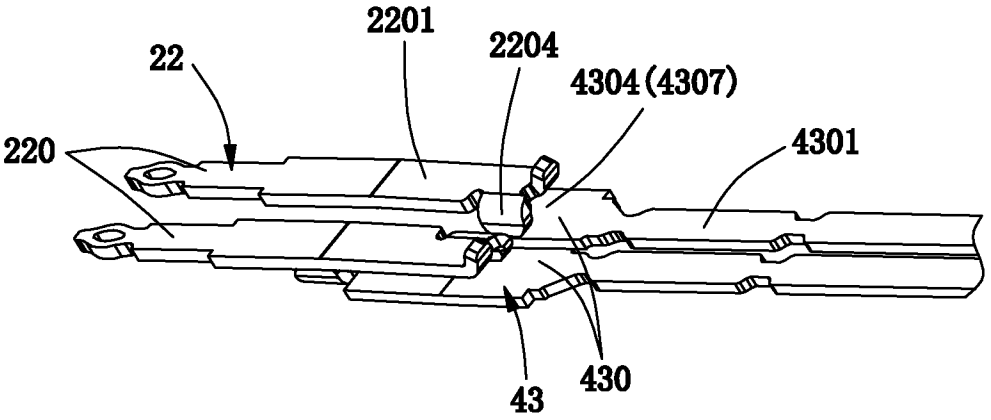
FIG. 6 is a schematic view of one pair of differential signal receptacle terminals and one pair of differential signal plug terminals after mating.
Figure 7:
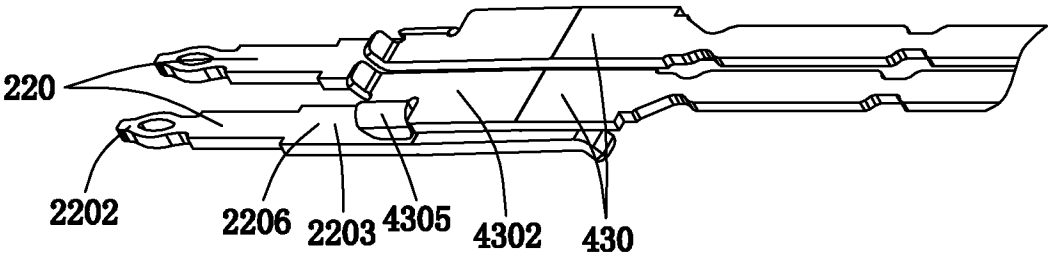
FIG. 7 is a schematic view of the two pairs of terminals along another direction after mating.
Figure 8:
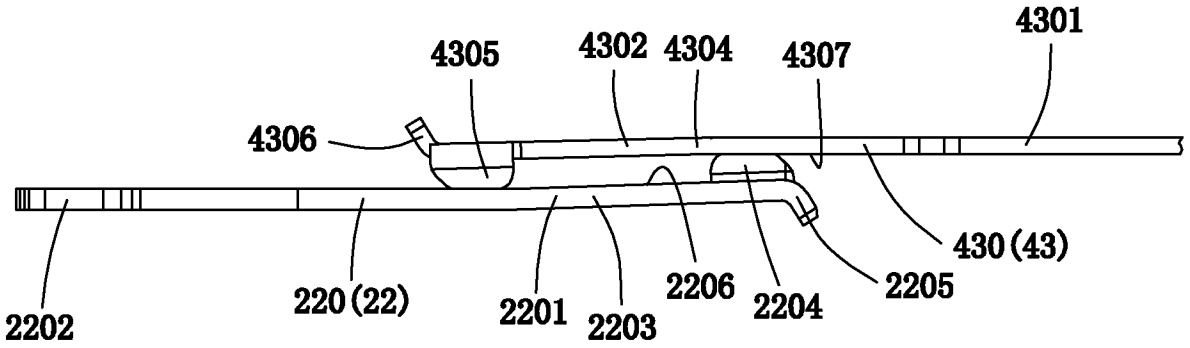
FIG. 8 is a side view showing the two pairs of terminals after mating.

Please refer to FIGS. 6 to 8, when the receptacle connector 10 and the plug connector 20 shown in FIG. 1 are electrically engaged with each other, the receptacle terminal 430 and the plug terminal 220 are mated together. Specifically, as shown in FIGS. 7 and 8, the extension section 4305 of the first L-type contact piece 4302 slides on the wide surface 2206 of the straight part 2203 and is finally pressed on the wide surface 2206. Meanwhile, please refer to FIGS. 6 and 8, the extension part 2204 of the second L-type contact piece 2201 slides toward the main plate 4301 on the wide side 4307 of the straight section 4304 and is finally pressed on the wide side 4307. Therefore, when the receptacle terminal 430 and the plug terminal 220 are mated together, there form double contacts between them. In other words, the extension section 4305 of the first L-type contact piece 4302 can contact with the wide surface 2206 of the straight part 2203 of the second L-type contact piece 2201 to form the electrical connection, and the extension part 2204 of the second L-type contact piece 2201 can contact with the wide side 4307 of the straight section 4304 of the first L-type contact piece 4302 to form the electrical connection again.

Furthermore, as shown in FIG. 8, the extension section 4305 of the first L-type contact piece 4302 extends toward the plug terminal 22, but the receptacle-guiding section 4306 extends away from the plug terminal 22. The extension part 2204 of the second L-type contact piece 2201 extends toward the receptacle terminal 43, but the plug-guiding part 2205 extends away from the receptacle terminal 43. Therefore, when the receptacle terminal 430 and the plug terminal 220 are engaged each other, the receptacle-guiding section 4306 and the plug-guiding part 2205 can provide a guiding function to ensure the smooth engagement of the two terminals and avoid unnecessary collisions.

As described above, the receptacle terminal 43 and the plug terminal 22 both dispose the L-type contact pieces 4302, 2201, so that there can form a double-contacts structure between the two terminals 43, 22 when the receptacle connector 10 and the plug connector 20 are electrically engaged. By this electrical engagement, the high speed connector assembly 1 of the present invention can restrain the short pile effect and reduce the crosstalk and loss when the transmission rate of the high speed signal is greater than 25 Gbps-40 Gbps.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A high speed connector assembly, which comprises:

a receptacle connector including at least an insulating cover and multiple terminal modules fixed in the insulating cover and arranged in parallel; each terminal module including an insulating frame and a terminal group retained in the insulating frame; the terminal group including a plurality of receptacle terminals, each of which has a main plate located in a first vertical plane, a first L-type contact piece extending forward from one end of the main plate, and a lower mounting portion extending downward from the other end of the main plate; the first L-type contact piece having a straight section and an extension section; the straight section being located in the first vertical plane, being connected with the main plate and horizontally extending forward; and the extension section being perpendicular to the first vertical plane, being formed by bending one edge of the straight section and being located near the front of the straight section; and a plug connector including a plug housing and multiple rows of plug terminals mounted in the plug housing; each plug terminal having a second L-type contact piece and a mounting part connected with the second L-type contact piece; the second L-type contact piece having a straight part located in a second vertical plane and an extension part being perpendicular to the second vertical plane and formed by bending one edge of the straight part; wherein the extension part is located near the top of the straight part;

wherein the second vertical plane is parallel to the first vertical plane;

when the receptacle connector and the plug connector being electrically engaged with each other, the extension section of the first L-type contact piece being pressed on the straight part of the second L-type contact piece to form the electrical connection between the receptacle and plug terminals; and the extension part of the second L-type contact piece being pressed on the straight section of the first L-type contact piece to form the electrical connection.

2. The high speed connector assembly as claimed in claim 1, wherein the first L-type contact piece further has a receptacle-guiding section formed by bending the front of the straight section along the direction away from the extension section; the extension section extends toward the plug terminal, but the receptacle-guiding section extends away from the plug terminal; and the second L-type contact piece further has a plug-guiding part formed by bending the top of the straight part along the direction away from the extension part; the extension part extends toward the receptacle terminal, but the plug-guiding part extends away from the receptacle terminal.

3. The high speed connector assembly as claimed in claim 1, wherein the straight section of the receptacle terminal has at least a wide side located in the first vertical plane, and the extension section is formed by perpendicularly bending one edge of the wide side; and the straight part of the plug terminal has at least a wide surface located in the second vertical plane, and the extension part is formed by perpendicularly bending one edge of the wide surface;

when the receptacle connector and the plug connector are engaged with each other, the extension section of the first L-type contact piece can contact with the wide surface of the second L-type contact piece to form the electrical connection; and the extension part of the second L-type contact piece can contact with the wide side of the first L-type contact piece to form the electrical connection.

4. The high speed connector assembly as claimed in claim 1, wherein the main plate is L type, the lower mounting portion is located in the first vertical plane, and the mounting part is located in the second vertical plane.

5. The high speed connector assembly as claimed in claim 1, wherein the receptacle terminals of each terminal group include multiple pairs of differential signal receptacle terminals and multiple grounding receptacle terminals; there are two grounding receptacle terminals respectively arranged on two sides of each pair of differential signal receptacle terminals; each pair of differential signal receptacle terminals includes two differential signal receptacle terminals, the first L-type contact pieces of which are symmetrical; and each row of plug terminals includes multiple pairs of differential signal plug terminals and multiple grounding plug terminals; there are two grounding plug terminals respectively arranged on two sides of each pair of differential signal plug terminals; each pair of differential signal plug terminals includes two differential signal plug terminals, the second L-type contact pieces of which are symmetrical.

6. The high speed connector assembly as claimed in claim 1, wherein the plug housing includes a base and two sidewalls standing on two sides of the base; and the base forms multiple rows of insertion holes to be used to hold the corresponding plug terminals.

7. A receptacle connector, which comprises:

an insulating cover; and multiple terminal modules fixed in the insulating cover and arranged in parallel; each terminal module including an insulating frame and a terminal group retained in the insulating frame; the terminal group including a plurality of receptacle terminals, at least one of which has a main plate located in a first vertical plane, a first L-type contact piece extending forward from one end of the main plate, and a lower mounting portion extending downward from the other end of the main plate; the first L-type contact piece having a straight section and an extension section; the straight section being located in the first vertical plane, being connected with the main plate and horizontally extending forward; and the extension section being perpendicular to the first vertical plane, being formed by bending one edge of the straight section and being located near the front of the straight section.

8. The receptacle connector as claimed in claim 7, wherein the first L-type contact piece further has a receptacle-guiding section formed by bending the front of the straight section along the direction away from the extension section;

the straight section has at least a wide side located in the first vertical plane, and the extension section is formed by perpendicularly bending one edge of the wide side.

9. The receptacle connector as claimed in claim 7, wherein the main plate is L type, and the lower mounting portion is located in the first vertical plane.

10. A plug connector, which comprises:

a plug housing including a base and two sidewalls standing on two sides of the base; the base forming multiple rows of insertion holes; and multiple rows of plug terminals being mounted in the plug housing and held in the corresponding insertion holes; at least one of the plug terminals having a L-type contact piece and a mounting part connected with the L-type contact piece; the L-type contact piece having a straight part located in a vertical plane and an extension part being perpendicular to the vertical plane and formed by bending one edge of the straight part; and the extension part being located near the top of the straight part.

11. The plug connector as claimed in claim 10, wherein the L-type contact piece further has a plug-guiding part formed by bending the top of the straight part along the direction away from the extension part;

the straight part has at least a wide surface located in the vertical plane, and the extension part is formed by perpendicularly bending one edge of the wide surface; and the mounting part is located in the vertical plane.

* * * * *